US010163423B2

(12) United States Patent
Chen et al.

(10) Patent No.: US 10,163,423 B2
(45) Date of Patent: Dec. 25, 2018

(54) BACKLIGHT CONTROL AND IMAGE COMPENSATION METHOD APPLIED TO DISPLAY AND ASSOCIATED CONTROL METHOD

(71) Applicant: MStar Semiconductor, Inc., Hsinchu Hsien (TW)

(72) Inventors: Chung-Yi Chen, Hsinchu County (TW); Cheng-Liang Wang, Hsinchu County (TW)

(73) Assignee: MSTAR SEMICONDUCTOR, INC., Hsinchu Hsien (TW)

( * ) Notice: Subject to any disclaimer, the term of this patent is extended or adjusted under 35 U.S.C. 154(b) by 0 days.

(21) Appl. No.: 15/486,414

(22) Filed: Apr. 13, 2017

(65) Prior Publication Data

US 2018/0005599 A1 Jan. 4, 2018

(30) Foreign Application Priority Data

Jun. 30, 2016 (TW) ..... 105120753 A

(51) Int. Cl.

| | |
|---|---|
| ***G09G 5/10*** | (2006.01) |
| ***G09G 3/34*** | (2006.01) |
| ***G09G 5/06*** | (2006.01) |

(52) U.S. Cl.

CPC ..... *G09G 5/10* (2013.01); *G09G 3/3406* (2013.01); *G09G 3/3426* (2013.01); *G09G 5/06* (2013.01); *G09G 2320/0238* (2013.01); *G09G 2320/0285* (2013.01); *G09G 2320/066* (2013.01); *G09G 2320/0626* (2013.01); *G09G 2320/0646* (2013.01); *G09G 2320/0693* (2013.01); *G09G 2320/10* (2013.01); *G09G 2330/02* (2013.01); *G09G 2330/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 2008/0068328 | A1* | 3/2008 | Jou | G09G 3/3406 345/102 |
| 2011/0122057 | A1* | 5/2011 | Kim | G09G 3/3426 345/102 |
| 2013/0071034 | A1* | 3/2013 | Kunkel | H04N 7/0122 382/199 |

(Continued)

*Primary Examiner* — Jennifer Mehmood
*Assistant Examiner* — Deeprose Subedi
(74) *Attorney, Agent, or Firm* — WPAT, PC

(57) ABSTRACT

A control method of a display includes a statistics circuit, a backlight determining circuit and a backlight control circuit. The display includes a backlight module having a maximum luminance. The statistics module receives frame, and generates luminance statistical information of a plurality of blocks included in the frame. The backlight determining circuit determines a backlight intensity corresponding to each of the blocks according to the luminance statistical information of the blocks and the maximum luminance. At least one of the backlight intensities corresponding to the blocks is greater than a normal luminance, which is a backlight intensity corresponding to one of the blocks when a maximum power is evenly distributed on light emitting elements of the display. The backlight control circuit controls the luminance of the backlight module according to the backlight intensities.

20 Claims, 8 Drawing Sheets

(56) References Cited

U.S. PATENT DOCUMENTS

| | | | | |
|---|---|---|---|---|
| 2014/0307011 | A1* | 10/2014 | Ninan | G09G 3/342<br>345/691 |
| 2015/0070376 | A1 | 3/2015 | Fujine et al. | |
| 2016/0093243 | A1* | 3/2016 | Su | G09G 3/2003<br>345/690 |

* cited by examiner

BACKLIGHT CONTROL AND IMAGE COMPENSATION METHOD APPLIED TO DISPLAY AND ASSOCIATED CONTROL METHOD

This application claims the benefit of Taiwan application Serial No. 105120753, filed Jun. 30, 2016, the subject matter of which is incorporated herein by reference.

BACKGROUND OF THE INVENTION

Field of the Invention

The invention relates to a backlight control and image compensation method applied to a display, and an associated control circuit.

Description of the Related Art

To increase visual contrast and achieve power saving, for a region having a lower luminance in an image, some displays reduce the corresponding backlight intensity and compensate display data (i.e., a pixel value and/or a grayscale value) to allow a user to perceive the same luminance. Ideally, a visual effect of first reducing the backlight intensity and then compensating the display data is equivalent to a visual effect of without altering the backlight intensity and without compensating the display image. However, in some situations, when the backlight intensity is reduced, the compensation performed on the display data may exceed a maximum value allowed, such that the display data is clamped to the maximum luminance to cause loss in details of the image. For example, assuming that pixels having pixel values and/or grayscales 128 to 255 in the original display data are compensated to the pixel value and/or grayscale 255, not only details in the image become distorted but also the contrast of the image is reduced.

SUMMARY OF THE INVENTION

It is an object of the present invention to provide a backlight control and image compensation method applied to a display and an associated control circuit to solve issues of distorted details and reduced contrast of an image in the prior art.

According to an embodiment of the present invention, a control circuit of a display includes a statistics circuit, a backlight determining circuit and a backlight control circuit. The display includes a backlight module, which has a maximum power. The statistics circuit receives a frame, and generates luminance statistical information of a plurality of blocks included in the frame. The backlight determining circuit determines a backlight intensity corresponding to each of the blocks according to the luminance statistical information of the blocks and the maximum power. At least one of the backlight intensities corresponding to the blocks is greater than a normal luminance, which is a backlight intensity corresponding to one of the blocks when the maximum power is evenly distributed on light emitting elements of the display. The backlight control circuit controls the luminance of the backlight module according to the backlight intensities.

According to another embodiment of the present invention, a backlight control and image compensation method applied to a display is provided. The display includes a backlight module formed by a plurality of light emitting elements, and has a maximum power. The method includes:

receiving a frame, and generating luminance statistical information of a plurality of blocks included in the frame; determining a backlight intensity corresponding to each of the blocks according to luminance statistical information of the blocks and the maximum power, wherein at least one of the backlight intensities corresponding to the blocks is greater than a normal luminance that is a backlight intensity corresponding to one of the blocks when the maximum power is evenly distributed on the light emitting elements; and controlling the backlight module according to the backlight intensities.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
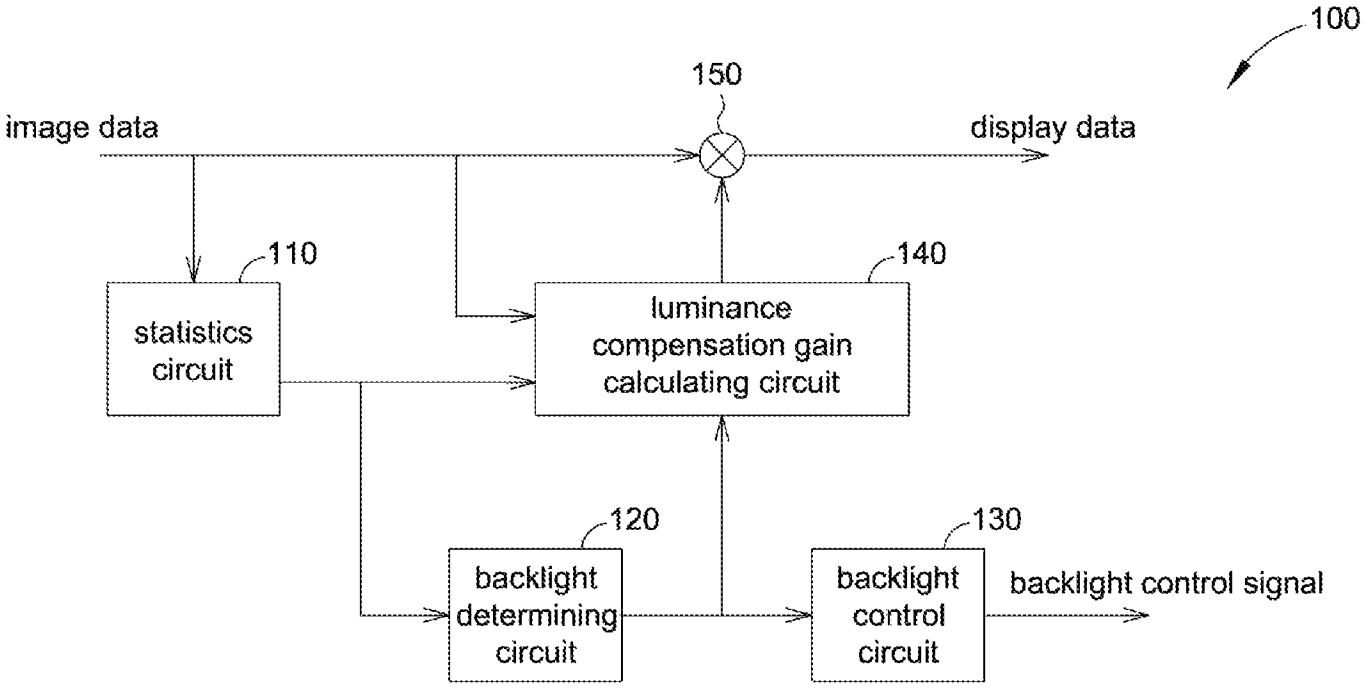
FIG. 1 is a block diagram of a control circuit according to an embodiment of the present invention.

FIG. 1 shows a block diagram of a control circuit according to an embodiment of the present invention. The control circuit 100 is disposed in a display, and is used to generate display data and a backlight control signal according to image data. The display data is provided to a panel of the display to control display of pixels, and the backlight control signal is provided to a backlight module of the display to control the luminance of each light emitting element. As shown in FIG. 1, the control circuit 100 includes a statistics circuit 110, a backlight determining circuit 120, a backlight control circuit 130, a luminance compensation gain calculating circuit 140, and a luminance compensating circuit 150. The above components may be implemented by one or multiple chips by means of software and hardware.

In an operation of the control circuit 100, the statistics circuit 110 receives image data of a frame, and calculates luminance statistical information of the frame and luminance statistical information of a plurality of blocks included in the frame. For example, the frame may be divided into M*N blocks, each of which at least corresponding to one light emitting element of the backlight module. The statistics circuit 110 calculates an average luminances of all pixel in the frame, a standard deviation of luminances of all pixels in the frame, an average luminance of all pixels in each of the blocks, and a standard deviation of luminances of all pixels in each of the blocks.

According to the luminance statistical information calculated by the statistics circuit 110, the backlight determining circuit 120 determines a backlight intensity of each of the blocks. A range of the backlight intensity of each of the blocks determined includes a maximum luminance that the corresponding turned-on light emitting element is capable of providing. The maximum luminance is higher than a normal luminance that the corresponding light emitting element of each of the blocks is capable of providing when all of the light emitting elements of the display are lit up. More specifically, a common light emitting element has a luminance range. Taking a light emitting diode (LED) controlled by a pulse-width modulation (PWM) signal for example, when a duty cycle of the PWM signal is 60%, the LED is allowed to present an extremum luminance. However, due to a power limitation of the backlight module or other factors, it is impossible for all of the LEDs present the extremum luminance at the same time. Thus, when all of the LEDs of backlight module of a common display are lit up, the duty cycle of the associated PWM signal may reach only 30% at most to control the illumination of the LEDs. The normal luminance is the backlight intensity corresponding to one of the blocks when the maximum power (the power limit) is evenly distributed on the LEDs; the maximum luminance is the greatest luminance that a driven LED of one block is capable of providing without considering the power limit. In the embodiment, the backlight intensity range that by the backlight determining circuit 12 for each of the blocks, instead of being lower than or equal to the normal luminance (e.g., corresponding to 0% to 30% of the duty cycle of the PWM signal) in the prior art, may include the maximum luminance (e.g., corresponding to 0% to 60% of the duty cycle of the PWM signal).

Next, the backlight control circuit 130 generates a corresponding backlight control signal according to the backlight intensity of each block determined by the backlight determining circuit 120 to control the luminance of each LED in the backlight module of the display.

Meanwhile, in response to the adjustment in the backlight, the luminance of image data also needs to be adjusted to allow a user to perceive the same visual effect. Thus, the luminance compensation gain calculating circuit 140 determines a compensation gain value for each of the pixels according to the luminance value of each of the pixels in the frame, the luminance statistical information of each of the blocks in the frame and the backlight intensity of each of the blocks in the frame. Next, the luminance compensating circuit 150 multiples the luminance value of each of the pixels in the frame by the corresponding compensation gain value to obtain an adjusted luminance value, and provides the adjusted luminance value as the display data to the panel for display. The luminance compensating circuit 150 may be implemented by a multiplier.

Figure 2:
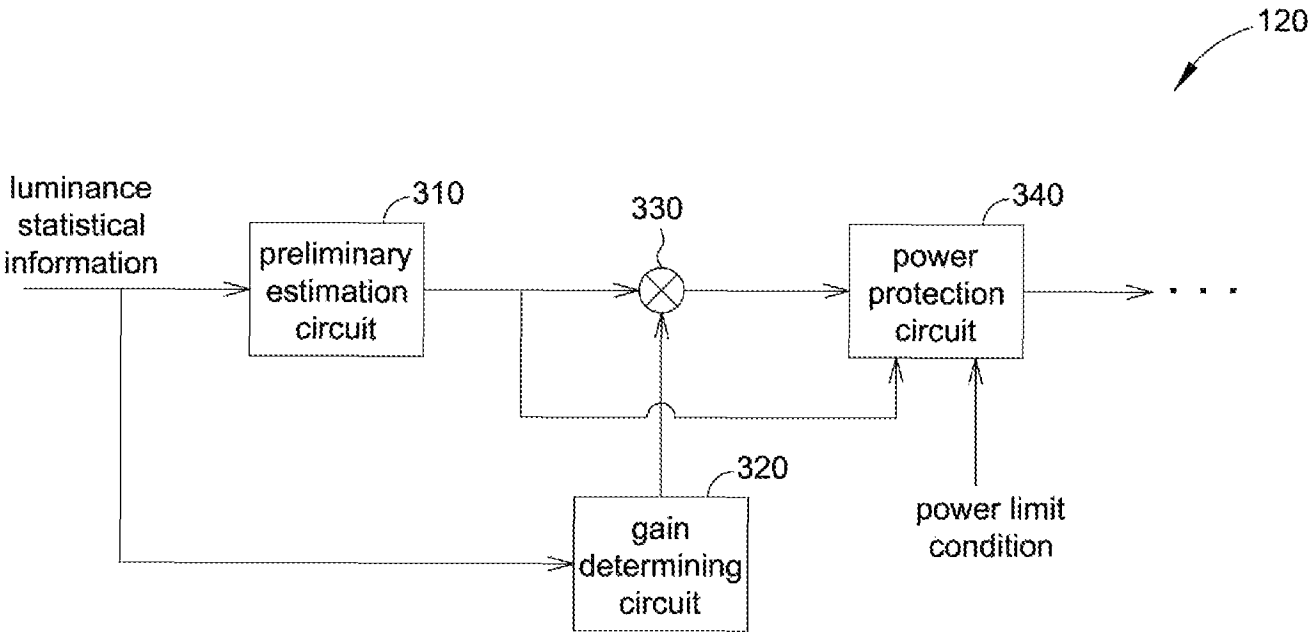
FIG. 2 is a block diagram of a backlight determining circuit according to an embodiment of the present invention.

FIG. 2 shows a block diagram of the backlight determining circuit 120 according to an embodiment of the present invention. The backlight determining circuit 120 includes a preliminary estimation circuit 310, a gain determining circuit 320, an adjusting circuit 330 and a power protection circuit 340. The preliminary estimation circuit 310 determines an initial backlight intensity of each of the blocks according to the luminance statistical information of each of the blocks. For example, the preliminary estimation circuit 310 provides a lower initial backlight intensity for a block corresponding to a dimmer image region, and provides a higher initial backlight intensity for a block corresponding to a brighter image region. For example, the range of the initial backlight intensity is 0% to 30% of the duty cycle of the PWM signal; that is, the foregoing normal luminance may be achieved at most.

Figure 3:
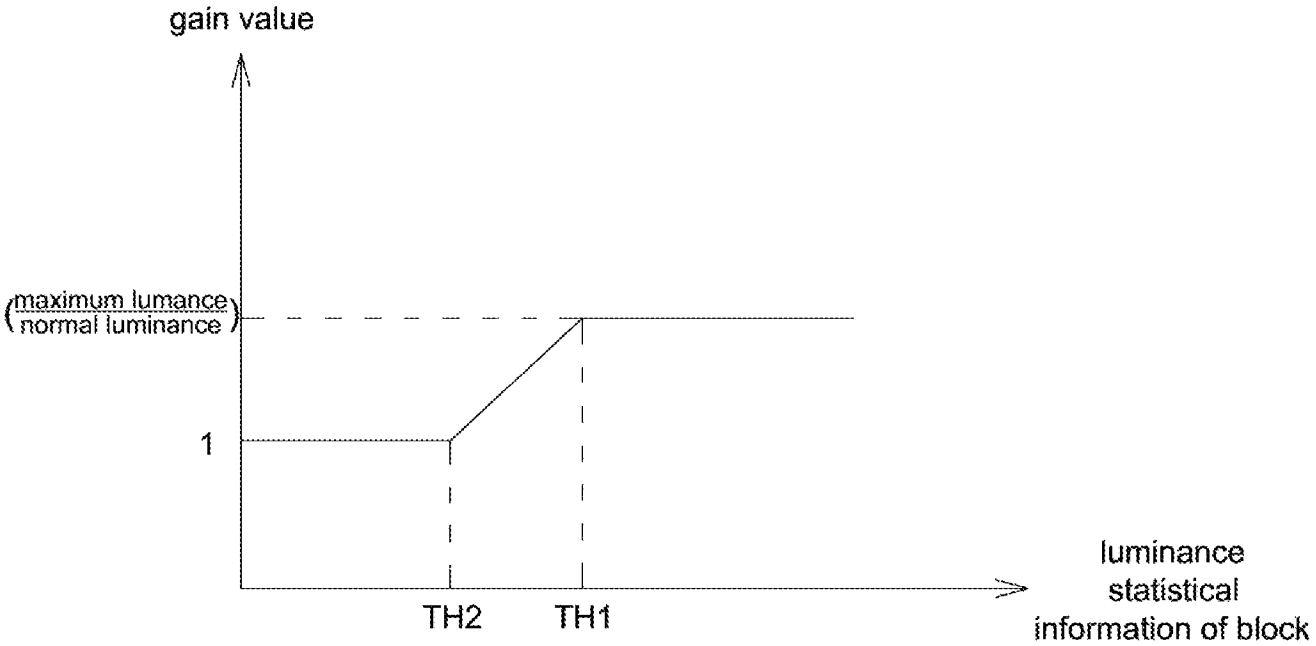
FIG. 3 is a schematic diagram of determining a gain value according to luminance statistical information of blocks.

The gain determining circuit 320 determines the gain value for each of the blocks according to the luminance statistical information of the frame. For example, referring to FIG. 3, when the luminance statistical information (e.g., the average luminance of all pixels in a block) of a block is higher than a first threshold TH1, the gain value of the block is a maximum gain value. In the embodiment, the maximum gain value is equal to a quotient of the maximum luminance divided by the normal luminance. When the luminance statistical information (e.g., the average luminance of all pixels in a block) of the block is lower than a second threshold TH2, the gain value of the block is 1. When the luminance statistical information (e.g., the average luminance of all pixels in a block) of the block is between the first threshold TH1 and the second threshold TH2, the gain value of the block is positively correlated with the luminance statistical information of the block (e.g., as shown in FIG. 3).

In one embodiment, the first threshold TH1 is a sum of the average pixel luminance of the frame and a standard deviation of the pixel luminance of the frame; the second threshold TH2 is a difference between the average pixel luminance of the frame and the standard deviation of the pixel luminance of the frame. The present invention is not limited to the above example.

The adjusting circuit 330 generates the adjusted backlight intensity of each of the blocks according to the initial backlight intensity of each of the blocks and the gain value. Further, the adjusting circuit 330 may be implemented by a multiplier. Thus, the range of the backlight intensity of each of the blocks corresponds to 0% to 60% of the duty cycle of the PWM signal, i.e., achieving the foregoing maximum luminance.

Figure 4:
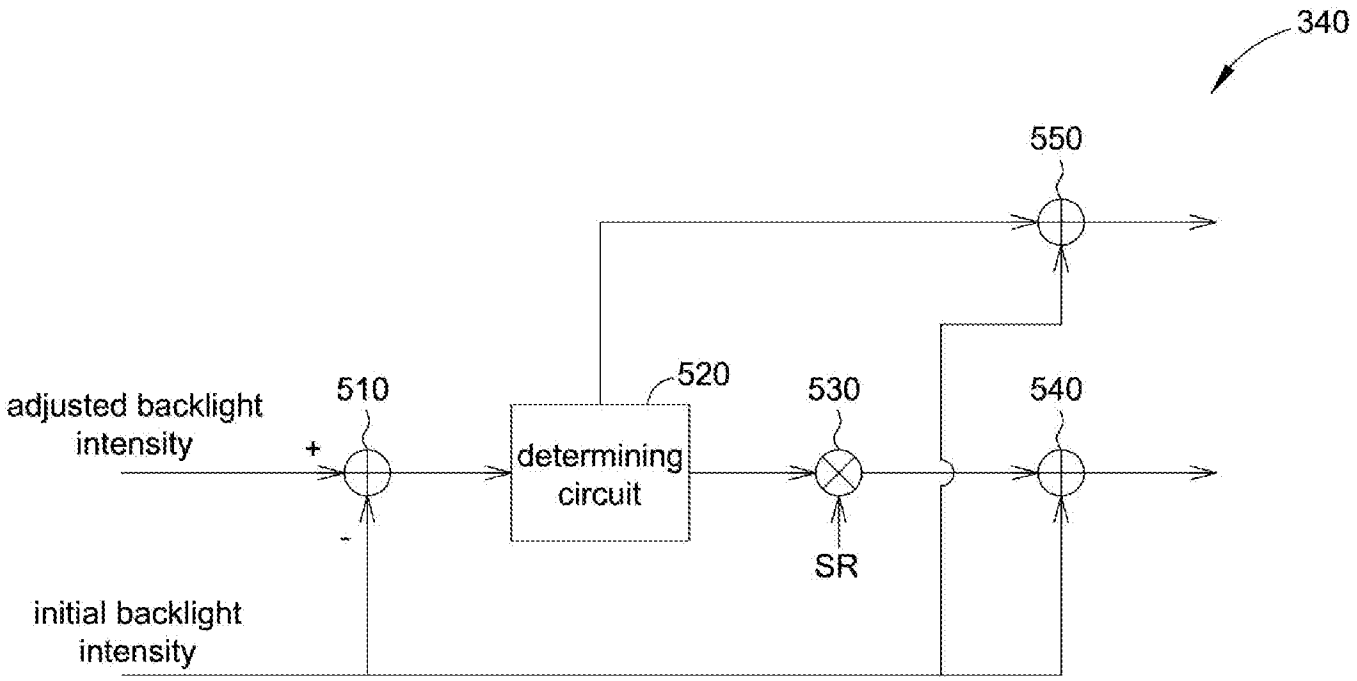
FIG. 4 is a block diagram of a power protection circuit according to an embodiment of the present invention.

Operations of the preliminary estimation circuit 310, the gain determining circuit 320 and the adjusting circuit 330 are performed in a unit of a block. To prevent the overall power consumption from exceeding the limitation of the backlight module, the power protection circuit 340 determines the backlight intensity to be outputted to each block of the backlight control circuit 130 according to the adjusted backlight intensity of each block and a maximum power (a power limit). FIG. 4 shows a block diagram of the power protection circuit 340 according to an embodiment of the present invention.

Referring to FIG. 4, the power protection circuit 340 includes a subtractor 510, a determining circuit 520, a multiplier 530, and two adders 540 and 550. In an operation of the power protection circuit 340, for each block, the subtractor 510 subtracts the adjusted backlight intensity generated by the adjusting circuit 330 and the initial backlight intensity generated by the preliminary estimation circuit 310 from each other to obtain a difference. If the difference is greater than 0, it means that the backlight intensity of the block has been increased (i.e., the gain value generated by the gain determining circuit 320 is greater than 1). Next, the determining circuit 520 determines whether the difference is greater than 0 to further determine which path is to be used for subsequent processing. In this embodiment, if the difference is equal to 0, the difference is transmitted to the adder 550 and is added with the initial backlight intensity to generate a final backlight intensity of the block. That is to say, the final backlight intensity is the adjusted backlight intensity if the difference is equal to 0. If the difference is greater than 0, the difference is transmitted to the multiplier 530 to be multiplied with a power down-scaling ratio SR, and the result is transmitted to the adder 540 and is added with the initial backlight intensity to generate the final backlight intensity of the block.

In this embodiment, the power down-scaling ratio SR is determined according to the maximum power (i.e., the power limit) that the backlight module allows and a total power corresponding to the adjusted backlight intensities of the blocks. For example, the power down-scaling ratio SR may be calculated by: SR=1−(P_total−PC)/sum(boosting), where P_total is the total power when the backlight module uses the adjusted backlight intensities, PC is the power limit of the backlight module, and sum(boosting) is the sum of differences between the respective adjusted backlight and the respective initial backlight intensities of the blocks.

Through the embodiment in FIG. 2 to FIG. 4, under the premise that the backlight module satisfies the power limit, a part of the light emitting elements are driven by a larger power, such that some of the blocks having higher luminances may appear brighter to further enhance the contrast of the overall image.

Figure 5:
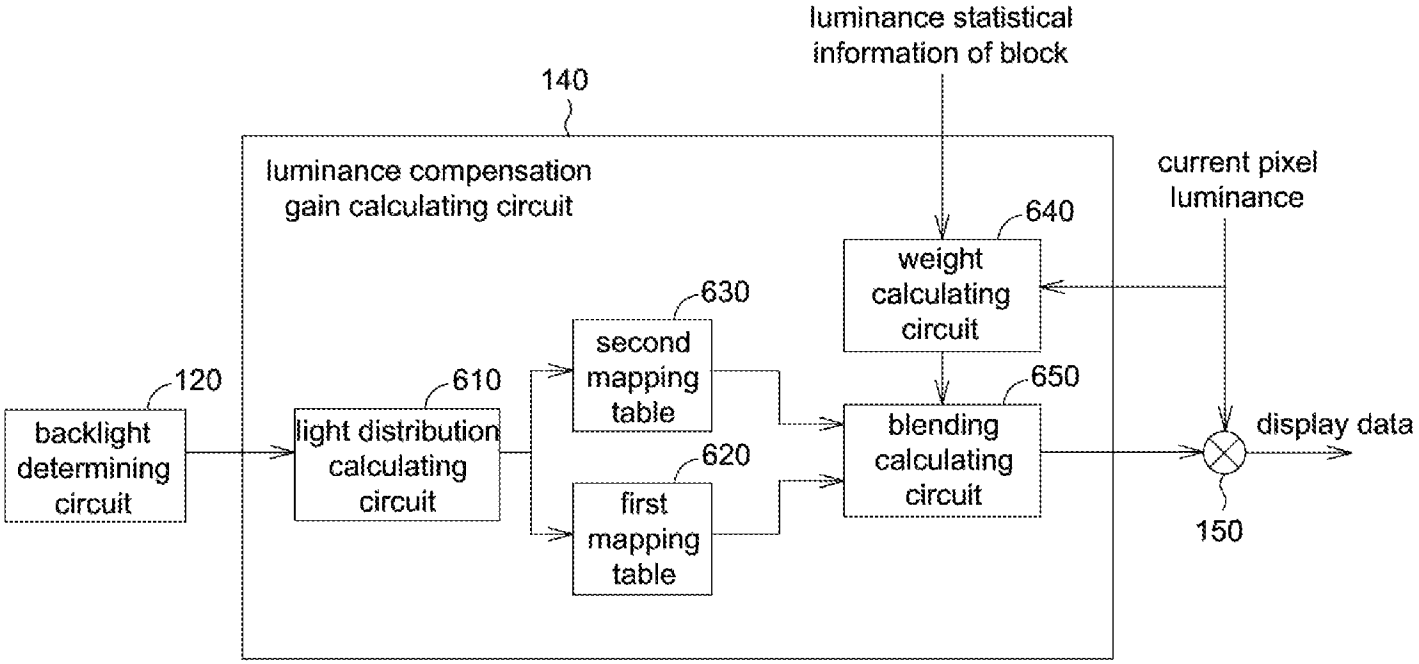
FIG. 5 is a block diagram of a luminance compensation gain calculating circuit according to an embodiment of the present invention.

FIG. 5 shows a block diagram of the luminance compensation gain calculating circuit 140 according to an embodiment of the present invention. As shown in FIG. 5, the luminance compensation gain calculating circuit 140 includes a light distribution calculating circuit 610, a first mapping table 620, a second mapping table 630, a weight calculating circuit 640 and a blending calculating circuit 650. In an operation of the luminance compensation gain calculating circuit 140, the light distribution calculating circuit 610 calculates a sum of backlight intensities (a total backlight intensity) that each block receives from the backlight module. In addition to receiving the light beams from the light emitting elements located right behind, each block also receives light beams generated by the light emitting elements corresponding to nearby blocks. Thus, the light distribution calculating circuit 610 determines the total backlight intensity received by each block according to multiple light emitting elements and respective light distribution functions of the light emitting elements.

Figure 6:
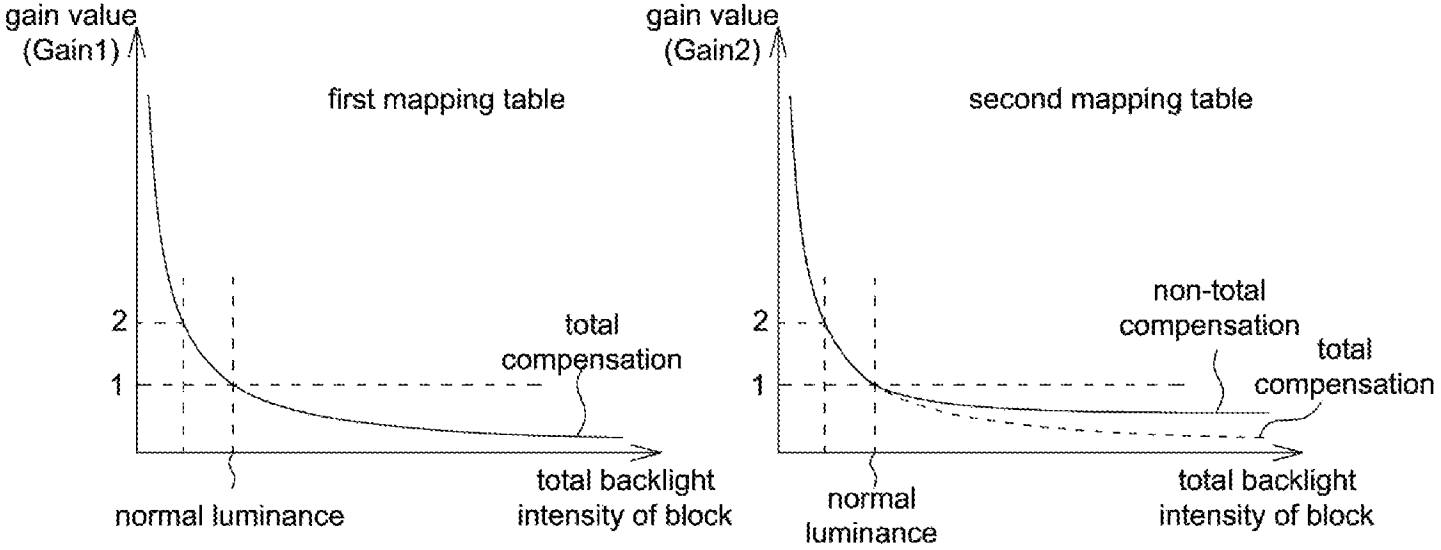
FIG. 6 is a schematic diagram of a first mapping table and a second mapping table.

Next, the first mapping table 620 determines a total compensation gain value for each of the blocks according to the total backlight intensity that each of the blocks receives from the backlight module, and the second mapping table 630 determines a non-total compensation gain value for each of the blocks according to the total backlight intensity that each of the blocks receives from the backlight module. More specifically, FIG. 6 shows a schematic diagram of the first mapping table 620 and the second mapping table 630. In the first mapping table 620, a curve of total compensation is depicted. That is, the gain (Gain1) determined by the first mapping table 620 is a total compensation gain value, which causes each pixel in a block to display a luminance that is substantially equal to the luminance of the original image data. For example, the gain value may be equivalently multiplying the grayscale value of the pixels by two times assuming that the total backlight intensity of a block is only one-half of the normal luminance, or the gain value may be 0.5 to lower the grayscale vale of the pixels assuming that the total backlight intensity of a block is twice of the normal luminance, so that each pixel is allowed to display a luminance that is substantially equal to the luminance of the original image data when displayed on the display. On the other hand, in the second mapping table 630, a curve of non-total compensation is depicted (the dotted line indicates the curve of total compensation in FIG. 620 for a comparison purpose). That is, the gain value (Gain2) determined by the second mapping table 630 is a non-total compensation gain value, in a way that when the total backlight intensity of a block is greater than the normal luminance, a pixel in the block has a luminance substantially higher than the luminance of the original image data when displayed on a display.

In the embodiment, when the total backlight intensity of a block is lower than a normal luminance, the curves of the first mapping table 620 and the second mapping table 630 are identical; when the total backlight intensity of a block is higher than the normal luminance, the gain value (Gain2) generated by the second mapping table 630 is higher than the gain value (Gain1) generated by the first mapping table 620.

It should be noted that, the first mapping table 620 and the second mapping table 630 in FIG. 5 and FIG. 6 applies a determination standard in a unit of a block; that is, the same block has one gain (Gain1) determined by the first mapping table 620 and one gain (Gain2) determined by the second mapping table 630. To enable the luminance compensation gain calculating circuit 140 to perform compensation in a unit of pixels to achieve better image quality and better contrast, the weight calculating circuit 640 determines a weight corresponding to each of the pixels according to a luminance value of the pixel, and the blending calculating circuit 650 blends the gain value (Gain1) determined by the first mapping table 620 and the gain value (Gain2) determined by the second mapping table 630 according to the calculated weights to obtain the corresponding compensation gain value. For example, the blending calculating circuit 650 calculates the compensation gain value of a pixel by an equation below:

$$\text{Gain: } \text{Gain}=\alpha*\text{Gain2}+(1-\alpha)*\text{Gain1}$$

Figure 7:
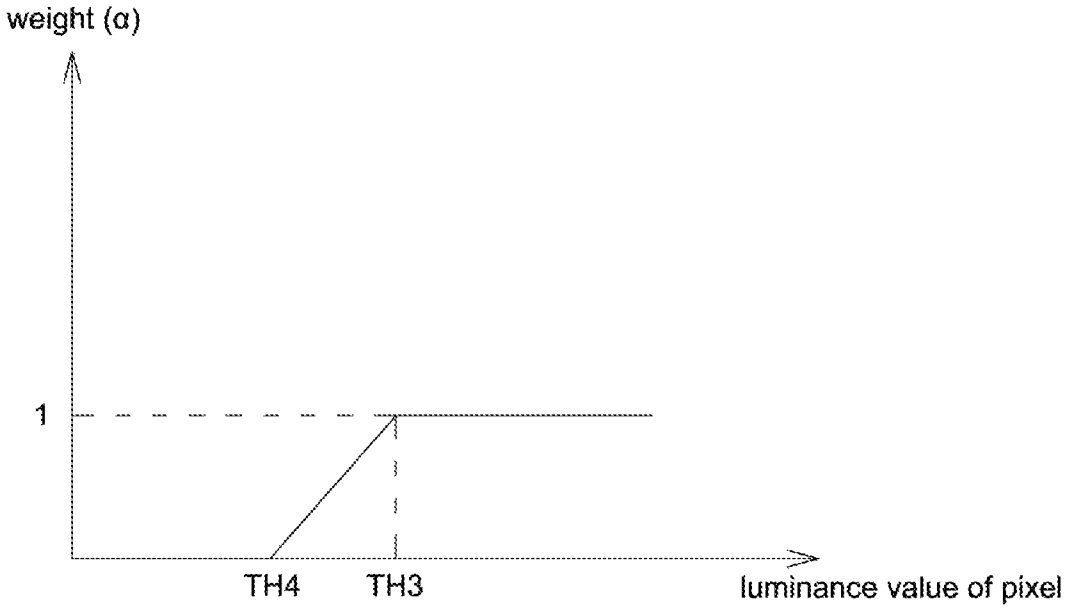
FIG. 7 is a schematic diagram of a weight of a gain (Gain2) that a weight calculating circuit determines according to a luminance value of each pixel.

For example, FIG. 7 shows a schematic diagram of a weight a that the weight calculating circuit 640 calculates according to the luminance value of each pixel. As shown in FIG. 7, when the luminance value of a pixel is greater than a third threshold TH3, the weight a of the gain value (Gain2) determined by the weight calculating circuit 640 is "1" and the weight of the gain value (Gain1) is "0" (i.e., 1−α). When the luminance value of the pixel is smaller than a fourth threshold TH4, the weight a of the gain value (Gain2) determined by the weight calculating circuit 640 is "0" and the weight of the gain value (Gain1) is "1" (i.e., 1−α). When the luminance value of the pixel is between the third threshold TH3 and the fourth threshold TH4, the weight a of the gain value (Gain2) determined by the weight calculating circuit 640 is positively correlated with the luminance value of the pixel, and the weight (i.e., 1−α) of the gain value (Gain1) determined by the weight calculating circuit 640 is inversely proportional to the luminance value of the pixel. That is to say, when the luminance value of a pixel is greater than the third threshold TH3, the compensation gain value corresponding to the pixel is a non-total compensation gain value (i.e., Gain2); when the luminance value of the pixel is smaller than the fourth threshold TH4, the compensation gain value corresponding to the pixel is the total compensation gain value (i.e., Gain1); and when the luminance value of the pixel is between the third threshold TH3 and the fourth threshold TH4, the weight of the non-total compensation gain value is positively correlated with the luminance value of the pixels and the weight of the total compensation gain value is inversely proportional to the luminance value of the pixel.

In one embodiment, for example but not limited to, the third threshold TH3 is a sum of an average image luminance of a block where the pixel is located and a standard deviation of the image luminance of the block, and the fourth threshold TH4 is a difference between the average image luminance of the block and the standard deviation of image luminance of the block.

The luminance compensating circuit 150 multiplies the luminance value of the pixel by the corresponding compensation gain value to obtain the adjusted luminance value, and displays the adjusted luminance value on the display.

Through the above operation, for a block having a higher backlight intensity, the luminance value of a pixel originally having a higher luminance is increased to further enhance the contrast of the image.

Figure 8:
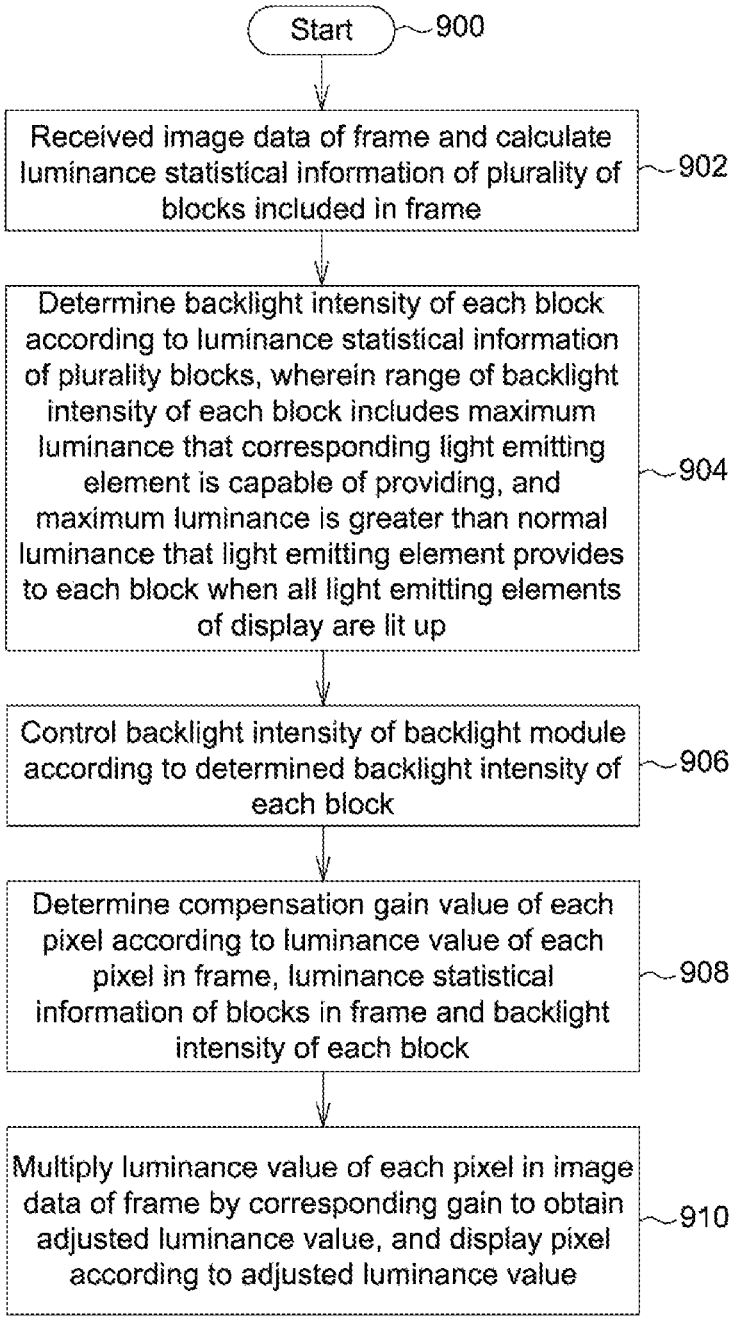
FIG. 8 is a flowchart of a backlight control and image compensation method applied to a display according to an embodiment of the present invention.

FIG. 8 shows a flowchart of a backlight control and image compensation method applied to a display. Referring to the above disclosure, the process in FIG. 8 includes following steps.

In step 900, the process begins.

In step 902, image data of a frame is received, and luminance statistical information of a plurality of blocks included in the frame is calculated.

In step 904, a backlight intensity of each of the blocks is calculated according to the luminance statistical information of the blocks. A range of the determined backlight intensity of each of the blocks includes a maximum luminance that a corresponding turned-on light emitting element is capable of providing. The maximum luminance is higher than a normal luminance that the light emitting elements of each block is capable of providing when all of the light emitting elements of the display are lit up.

In step 906, a backlight intensity of a backlight module of the display is controlled according to the determined backlight intensity of each block.

In step 908, a compensation gain value is determined for each of the pixels in the image data of the frame according to the luminance value of each pixel in the image data, the luminance statistical information of the blocks included in the frame, and the backlight intensity of each of the blocks.

In step 910, the luminance value of each of the pixels in the image data of the frame is multiplied by the corresponding compensation gain value to obtain the adjusted luminance value, and the pixels are displayed according to the adjusted luminance values.

In summary, in the backlight control and image compensation method applied to a display and the associated control circuit of the present invention, under the premise that the backlight module satisfies the power limit, a part of the light emitting elements are driven by a larger power, such that some of the blocks having higher luminances may appear brighter to further enhance the contrast of the overall image. Further, for a block having a high luminance, a non-total compensation may be performed on the corresponding display data, such that the pixels originally having high luminances in the block having a high luminance may appear brighter to further enhance the contrast. Thus, the backlight intensity of a block having a luminance may be significantly increased, and the backlight emitted from the block having a high luminance may relatively reduce the luminance requirement of a block having a low luminance, thereby achieving effects of focused light patterns and enhancing the contrast as well as eliminating/alleviating the issue of distorted details in an image.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A control circuit, applied to a display comprising a backlight module formed by a plurality of light emitting elements and having a maximum luminance, the control circuit comprising:

a statistics circuit, receiving a frame, and generating luminance statistical information of a plurality of blocks comprised in the frame;

a backlight determining circuit, determining a backlight intensity corresponding to each of the blocks according to the luminance statistical information of the blocks and the maximum luminance, wherein at least one of the backlight intensities corresponding to the blocks is greater than a normal luminance, the normal luminance is a backlight intensity corresponding to one of the blocks when a maximum power is evenly distributed on the light emitting elements, and the maximum luminance is a highest luminance emitted from each of the light emitting elements; and a backlight control circuit, controlling the backlight module according to the backlight intensities.

2. The control circuit according to claim 1, wherein the backlight determining circuit comprises:

a preliminary estimation circuit, determining an initial backlight intensity of each of the blocks according to the luminance statistical information of the blocks, wherein the initial backlight intensity is smaller than or equal to the normal luminance;

a gain determining circuit, determine a gain value of each of the blocks according to the luminance statistical information; and an adjusting circuit, adjusting the initial backlight intensity corresponding to each of the blocks according to the gain value corresponding to each of the blocks to generate an adjusted backlight intensity of each of the blocks.

3. The control circuit according to claim 2, wherein for each of the blocks, the gain determining circuit determines that a gain value corresponding to the block is a maximum gain value when the luminance statistical information of the block is greater than a first threshold, determines that the gain value corresponding to the block is "1" when the luminance statistical information of the block is smaller than a second threshold, and determines that the gain value corresponding to the block is between the maximum gain and "1" and is positively correlated with the luminance statistical information of the block when the luminance statistical information of the block is between the first threshold and the second threshold.

4. A control circuit, applied to a display comprising a backlight module formed by a plurality of light emitting elements and having a maximum luminance, the control circuit comprising:

a statistics circuit, receiving a frame, and generating luminance statistical information of a plurality of blocks comprised in the frame;

a backlight determining circuit, determining a backlight intensity corresponding to each of the blocks according to the luminance statistical information of the blocks and the maximum luminance, wherein at least one of the backlight intensities corresponding to the blocks is greater than a normal luminance, the normal luminance is a backlight intensity corresponding to one of the blocks when a maximum power is evenly distributed on the light emitting elements, and the maximum luminance is a highest luminance emitted from each of the light emitting elements; and a backlight control circuit, controlling the backlight module according to the backlight intensities;

wherein luminance statistical information the luminance statistical information of the block is an average pixel luminance of the block, the first threshold is a sum of an average pixel luminance of the frame and a standard deviation of pixel luminance of the frame, and the second threshold is a difference between the average pixel luminance of the frame and the standard deviation of the pixel luminance of the frame.

5. The control circuit according to claim 2, wherein the backlight determining circuit further comprises:

a power protection circuit, determining the backlight intensity of each of the blocks to be outputted to the backlight module according to the adjusted backlight intensity of each of the blocks and the maximum luminance.

6. The control circuit according to claim 5, wherein when a total power of the respective adjusted backlight intensities of the blocks in the frame is greater than the maximum power, a power down-scaling ratio is determined according to the maximum power and the total power, and the power protection circuit reduces the adjusted backlight intensities of a part of the blocks according to the power down-scaling ratio to determine the backlight intensities of that part of the blocks.

7. The control circuit according to claim 1, further comprising:

a luminance compensation gain calculating circuit, determining a compensation gain value of each of pixels in the frame according to a luminance value of each of the pixels in the frame, the luminance statistical information of the blocks and the backlight intensity of each of the blocks; and a luminance compensating circuit, multiplying the luminance value of each of the pixels in the frame by the corresponding compensation gain value to obtain an adjusted luminance value.

8. The control circuit according to claim 7, wherein the luminance compensation gain calculating circuit comprises:

a light distribution calculating circuit, calculating a total backlight intensity that each of the blocks receives from the light emitting elements;

a first mapping table, determining a total compensation gain value of each of the pixels according to the luminance statistical information of the blocks and the total backlight intensity received by each of the blocks;

a second mapping table, determining a non-total compensation gain value of each of the pixels according to the luminance statistical information of the blocks and the total backlight intensity received by each of the blocks; and a blending calculating circuit, determining the compensation gain value of each of the pixels according to the total compensation gain value and the non-total compensation gain value of each of the pixels.

9. The control circuit according to claim 8, wherein for one predetermined pixels among the pixels, when the total backlight intensity of a predetermined block in which the predetermined pixel is located is lower than a threshold, the total compensation gain value and the non-total compensation gain value corresponding to the predetermined pixel are equal; when the total backlight intensity of the predetermined block is greater than the threshold, the total compensation gain value corresponding to the predetermined pixel is lower than the non-total compensation gain value.

10. The control circuit according to claim 9, wherein when the luminance compensating circuit compensates the luminance value of the predetermined pixel according to the total compensation gain value corresponding to the predetermined pixel to obtain the adjusted luminance value of the predetermined pixel, the predetermined pixel that the display displays according to the adjusted backlight intensities and the adjusted luminance value of the predetermined pixel has a same luminance value as the predetermined pixel in the frame.

11. The control circuit according to claim 8, wherein for a predetermined pixel among the pixels, the blending calculating circuit determines a weight of the total compensation gain value and a weight of the non-total compensation value in determining the compensation value according to the luminance value of the predetermined pixel.

12. The control circuit according to claim 11, wherein the blending calculating circuit determines that, the compensation gain value corresponding to the predetermined pixel value is the non-total compensation gain value when the luminance value of the predetermined pixel is greater than a third threshold, the compensation gain value corresponding to the pixel is the total compensation gain value when the luminance value of the predetermined pixel is smaller than a fourth threshold, and the weight of the non-total compensation gain value is positively correlated with the luminance value of the predetermined pixel and the weight of the total compensation gain value is negatively correlated with the luminance value of the predetermined pixel when the luminance value of the predetermined pixel is between the third threshold and the fourth threshold.

13. The control circuit according to claim 12, wherein the third threshold is a sum of an average pixel luminance of a predetermined block where the predetermined pixel is located and a standard deviation of pixel luminance of the predetermined block, and the fourth threshold is a difference between the average pixel luminance of the predetermined block and the standard deviation of the pixel luminance of the predetermined block.

14. A backlight control and image compensation method, applied to a display comprising a backlight module formed by a plurality of light emitting elements and having a maximum luminance, the control circuit comprising:

receiving a frame, and generating luminance statistical information of a plurality of blocks comprised in the frame;

determining a backlight intensity corresponding to each of the blocks according to the luminance statistical information of the blocks and the maximum luminance, wherein at least one of the backlight intensities corresponding to the blocks is greater than a normal luminance, the normal luminance is a backlight intensity corresponding to one of the blocks when a maximum power is evenly distributed on the light emitting elements, and the maximum luminance is a highest luminance emitted from each of the light emitting elements; and controlling the backlight module according to the backlight intensities.

15. The method according to claim 14, wherein the step of determining the backlight intensity corresponding to each of the blocks according to the luminance statistical information of the blocks and the maximum luminance comprises:

determining an initial backlight intensity of each of the blocks according to the luminance statistical information of the blocks, wherein the initial backlight intensity is smaller than or equal to the normal luminance;

determining a gain value of each of the blocks according to the luminance statistical information; and adjusting the initial backlight intensity corresponding to each of the blocks according to the gain value corresponding to each of the blocks to generate an adjusted backlight intensity of each of the blocks.

16. The method according to claim 15, wherein for one of the blocks, the step of determining the gain value of the block according to the luminance statistical information comprises:

determining that a gain value corresponding to the block is a maximum gain value when the luminance statistical information of the block is greater than a first threshold;

determining that the gain value corresponding to the block is "1" when the luminance statistical information of the block is smaller than a second threshold; and determining that the gain value corresponding to the block is between the maximum gain and "1" and is positively correlated with the luminance statistical information of the block when the luminance statistical information of the block is between the first threshold and the second threshold.

17. The method according to claim 16, wherein the luminance statistical information is an average pixel luminance of the block, the first threshold is a sum of an average pixel luminance of the frame and a standard deviation of pixel luminance of the frame, and the second threshold is a difference between the average pixel luminance of the frame and the standard deviation of the pixel luminance of the frame.

18. The method according to claim 15, wherein the step of determining the backlight intensity corresponding to each of the blocks according to the luminance statistical information of the blocks and the maximum luminance further comprises:

determining the backlight intensity of each of the blocks according to the adjusted backlight intensity of each of the blocks and the maximum power.

19. The method according to claim 18, wherein the step of determining the backlight intensity of each of the blocks according to the adjusted backlight intensity of each of the blocks and the maximum power comprises:

when a total power of the respective adjusted backlight intensities of the blocks in the frame is greater than the maximum power, determining a power down-scaling ratio according to the maximum power and the total power, and reducing the adjusted backlight intensities of a part of the blocks according to the power down-scaling ratio to determine the backlight intensities of that part of the blocks.

20. The method according to claim 14, further comprising:

determining a compensation gain value of each of pixels in the frame according to a luminance value of each of the pixels in the frame, the luminance statistical information of the blocks and the backlight intensity of each of the blocks; and multiplying the luminance value of each of the pixels in the frame by the corresponding compensation gain value to obtain an adjusted luminance value.

* * * * *